United States Patent [19]

Shannon et al.

[11] Patent Number: 4,793,515

[45] Date of Patent: Dec. 27, 1988

[54] SODA SYSTEM FOR SOFT DRINK DISPENSER

[75] Inventors: Joseph W. Shannon; Thomas S. Green, both of Kent, Ohio

[73] Assignee: American Business Computers, Mogadore, Ohio

[21] Appl. No.: 70,903

[22] Filed: Jul. 8, 1987

[51] Int. Cl.[4] ..... B67D 5/08

[52] U.S. Cl. ..... 222/69; 222/130; 222/136; 222/318; 222/396; 222/399; 222/424

[58] Field of Search ..... 222/67, 69, 130, 135, 222/136, 318, 396, 399, 424, 129.1, 129.2, 129.3, 129.4

[56] References Cited

U.S. PATENT DOCUMENTS

| | | | |
|---|---|---|---|
| 1,766,287 | 6/1930 | Tella | 222/424 X |
| 3,259,273 | 7/1966 | Kromer | 222/318 X |
| 3,370,755 | 2/1968 | Querner | 222/399 X |
| 3,731,845 | 5/1973 | Booth | 222/67 |
| 4,148,334 | 4/1979 | Richards | 222/129.1 X |

FOREIGN PATENT DOCUMENTS

| | | | |
|---|---|---|---|
| 2220160 | 11/1972 | Fed. Rep. of Germany | 222/399 |
| 2331813 | 1/1974 | Fed. Rep. of Germany | 222/129.1 |
| 888513 | 1/1962 | United Kingdom | 222/399 |

*Primary Examiner*—Joseph J. Rolla
*Assistant Examiner*—David H. Bollinger
*Attorney, Agent, or Firm*—Renner, Kenner, Greive, Bobak, Taylor & Weber

[57] ABSTRACT

A soda system for soft drink dispensers which includes an auxiliary tank adapted for maintaining a reservoir of cold soda for immediate dispensing, which soda is also recarbonated in the auxiliary tank. A recirculating pump passes soda from a carbonation unit sequentially to various dispensing stations for a return to the circulating pump. Interposed in the soda path is an auxiliary tank from which the dispensing of soda is actually made. The auxiliary tank communicates with a source of pressurized carbon dioxide to maintain a head of that gas therein for purposes of recarbonating the soda while providing the pressure head for dispensing the soda. Shunt lines are provided in communication with soda dispensing lines to assure that even the soda within the dispensing lines is recirculated and refreshed.

11 Claims, 1 Drawing Sheet

SODA SYSTEM FOR SOFT DRINK DISPENSER

TECHNICAL FIELD

The invention herein resides in the art of soft drink dispensers and, more particularly, to a related soda system.

BACKGROUND ART

Heretofore numerous types of soft drink dispensers have been known. It has previously been known to maintain a centralized carbonation unit for generating carbonated water or soda which is in turn circulated to various dispensing stations or pouring heads at various locations throughout an establishment. In such known systems, the soda and syrup pass in a bundle of tubes to the various dispensing stations, with the soda tubes making a full loop through a recirculating pump such that the soda itself is continually recycled to and from the dispensing stations. The desire of the prior art has been to maintain the carbonation level of the soda, maintain the soda at a low temperature, and by bundling the soda and syrup tubes together, to similarly maintain the syrup at a desired low temperature.

In the known prior art, there is no true recarbonation of the soda, but only a recirculation of the same. Such recirculation has been found to allow an escape of the entrained carbon dioxide from the soda, giving the soda a "flat" character, undesired in soft drinks. The prior art has failed to provide any auxiliary means for storing a reservoir of cold soda available for dispensing, while also recarbonating such soda to assure a proper carbonation level. The prior art has also failed to teach an efficient and effective means for recirculating soda to maintain desired temperature and carbonation levels. Additionally, the prior art has been devoid of a soda system utilizing a pressurized auxiliary tank to increase the capability of the beverage dispensing system to efficiently and effectively handle peak dispensing periods.

DISCLOSURE OF INVENTION

In light of the foreging, it is a first aspect of the invention to provide a soda system for soft drink dispensers which includes an auxiliary tank for receiving a reservoir of soda and maintaining a head of pressure of carbon dioxide.

Another aspect of the invention is the provision of a soda system for soft drink dispensers which is capable of recarbonating soda as it is circulated between and among various dispensing stations.

Still a further aspect of the invention is to provide a soda system for soft drink dispensers which may be quickly and easily implemented with presently existing soft drink systems.

Still an additional aspect of the invention is the provision of a soda system for soft drink dispensers in which full, complete and total recirculation of soda may be obtained, to assure optimum temperatures and carbonation levels.

Yet another aspect of the invention is the provision of a soda system for soft drink dispensers which is reliable in operation, inexpensive to construct, implement and maintain, and which is conducive to marriage with presently existing soft drink systems.

The foregoing and other aspects of the invention which will become apparent as the detailed description proceeds are achieved by a soda system for a soft drink dispenser, comprising: a carbonator interconnected between a source of water and a source of carbon dioxide for generating soda; a pump connected to said carbonator and circulating soda to at least one dispensing station and returning said soda to said carbonator; and an auxiliary tank maintained at said dispensing station, receiving said soda from said pump and in communication with said source of carbon dioxide, said auxiliary tank maintaining a reservoir of soda and a pressure head of carbon dioxide therein.

Yet other aspects of the invention are attained by a system for generating and maintaining soda for dispensing in a soft drink system, comprising: a carbonator for generating soda; a pressurized source of carbon dioxide in communication with said carbonator; a pump connected to said carbonator and at least one dispensing station for circulating soda to and from said dispensing station; an auxiliary tank maintained at said dispensing station, receiving said soda from said pump and in communication with said source of carbon dioxide, said auxiliary tank maintaining a reservoir of soda and a pressure head of carbon dioxide therein, and having an inlet passage receiving soda from said pump and an outlet passage returning soda to said pump; and a float switch maintained within said auxiliary tank and operatively connected to a first valve maintained within a vent within said auxiliary tank, said float switch selectively venting said pressure head to atmosphere through said first valve.

BRIEF DESCRIPTION OF DRAWINGS

For a complete understanding of the objects, techniques and structure of the invention reference should be had to the following detailed description and accompanying drawings wherein.

BEST MODE FOR CARRYING OUT THE INVENTION

Figure 1:
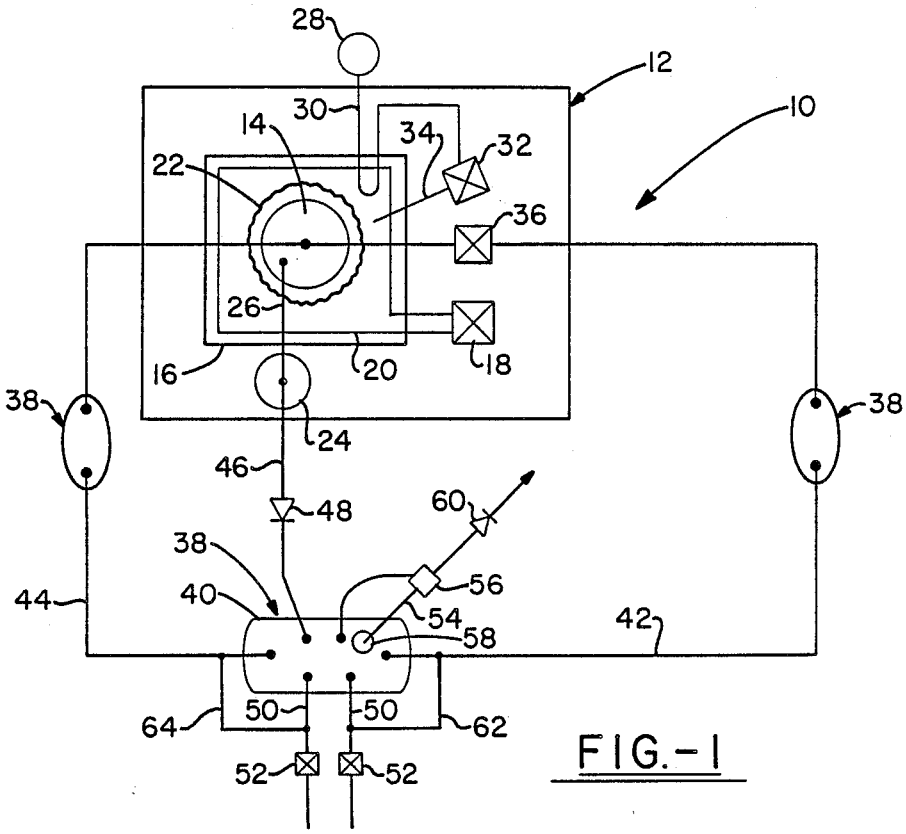
FIG. 1 is a schematic diagram of a soda system for a soft drink dispenser according to the invention.

With reference now to the drawings and more particularly FIG. 1, it can be seen that a soda system according to the invention is designated generally by the numeral 10. The soda system 10 includes a carbonation unit 12 having a carbonator tank 14 maintained within an insulated tank 16. Typically, the insulated tank 16 is filled with ice or water which is solidified to the state of ice by means of the compressor or refrigeration unit 18. As is well known in the art, the compressor 18 passes freon through the serpentine passages 20 maintained within the insulated tank 16 to withdraw heat therefrom and effectively chill, freeze or otherwise cool the contents of the tank 16. As is further well known to those skilled in the art, serpentine passages 22 are provided in association with the carbonator tank 14 for passing soda therethrough and within the chilled environment of the tank 16 to maintain the soda at as cold a temperature as possible.

As is further known in the art, a source of carbon dioxide ($CO_2$) 24 is provided in communication with the carbonator 14. Typically, the carbon dioxide source 24 provides such gas under pressure to the carbonator 14, preferably at a pressure of 80–120 psi, and preferably on the order of 90 psi. The carbon dioxide serves to carbonate water introduced to the carbonator 14, thereby generating soda. The carbon dioxide gas is passed to the carbonator by means of the conduit 26.

In somewhat standard fashion, any suitable bulk source of water 28 is also connected to the carbonation unit 12. The water source 28 passes through a conduit 30 which passes through the chilled insulated tank 16 to precool the water. The conduit 30 passes the water to the pump 32 where another conduit 34 introduces it to the carbonator tank 14. It will, of course, be understood that a float switch or the like is maintained within the carbonator 14 to allow the introduction of water thereunto upon demand. Typically, when the float switch determines a low level of soda within the tank 14, additional water is introduced. Suffice it to say that the carbonator 14 operates in the well known fashion of generating soda by the introduction or entraining of carbon dioxide thereinto by means of pressure.

Also as is well known in the art, a recirculation pump 36 is interconnected between the carbonator 14 and various dispensing stations 38 to allow the soda to sequentially circulate from one station to the next and back to the pump. It has previously been known that the outlet from the carbonator 14 is typically a "Tee" connection such that, while the soda does recirculate from station to station, it does not actually reenter the carbonator tank 14 once it has entered the pumping path.

The structure just described is somewhat well known in the art and does not, by itself, constitute a portion of the instant invention. It has been found, however, that the introduction of an auxiliary tank 40 at at least one of the dispensing stations 38 may allow for efficient and effective maintenance of a reservoir of cold soda which, though having been recirculated by means of the pump 36, is also recarbonated in the manner to be discussed hereinafter. Suffice it to say that the auxiliary tank 40 substantially increases the capability of the soda system 10 for dispensing larger volumes of cold properly carbonated soda than heretofore known in the art.

As shown in FIG. 1, the auxiliary tank 40, which itself is temperature insulated, has an input 42 for receiving soda from the prior station or the pump 36, and an output 44 for passing soda to the next subsequent station or the pump 36. It will be appreciated that the soda path of the invention is from the pump 36 to each of the stations sequentially, and then with a return to the pump 36.

The regulated and pressurized source of carbon dioxide 24 communicates with the auxiliary tank 40 through a conduit 46 having a check valve 48 maintained therein. The check valve 48 has a characteristic low cracking pressure on the order of 2–10 psi, and preferably 3 psi. Accordingly if the carbon dioxide source 24 is set at 90 psi, the tank 40 would receive a head pressure of 87 psi.

Figure 2:
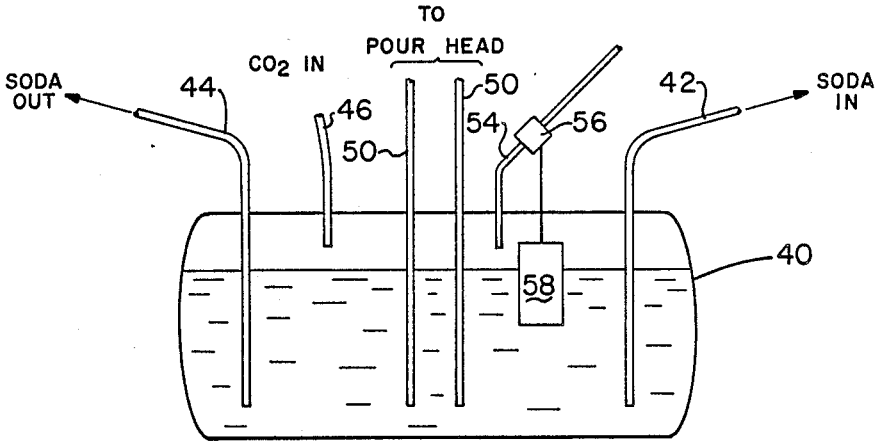
FIG. 2 is a schematic diagram of the auxiliary tank of the invention as employed in FIG. 1.

With continued reference to FIG. 1, and attention to FIG. 2, it will be seen that extending from the auxiliary tank 40 are a pair of dispensing lines 50, each having a dispensing valve 52 maintained therein. In standard fashion, an operator may simply actuate a selected one of the valves 52 to allow soda to be dispensed from the associated line 50 under the carbon dioxide pressure head introduced via the line 46 and check valve 48. A vent tube 54 is introduced into the pressure head of the tank 40 and is controlled by the valve 56 which is open when the float switch 58 reaches a preset lower level and closes when it reaches a preset higher level. In standard fashion, the float switch 58 is electrically connected to the valve 56 and is operative to allow a replenishment of the reservoir of soda within the insulated tank 40 by activating the valve 56, venting the tank 40 to atmosphere. A check valve 60 is interposed in the vent tube 54 and having a cracking pressure just below the head pressure introduced to the tank 40 via the source 54, conduit 46 and check valve 48. Typically, the characteristic cracking pressure of the valve 60 would be in excess of 90% of the pressure level of the pressurized carbon dioxide source 24. In a preferred embodiment, the cracking pressure of the valve 60 would be approximately 85 psi with the head pressure within the tank 40 being 87 psi. Accordingly, when the valve 56 is opened by the float switch 58, only a 2 psi differential is vented, preventing any significant escapement of carbon dioxide while allowing the reservoir level of soda within the tank 40 to rise to such a level that the switch 58 shuts the valve 56.

As also shown in FIG. 1, the dispensing lines 50, which contain soda therein immediately ready for dispensing, may be shunted to either the input 42 or the output 44 to allow for total recirculation of the soda. It will be understood that the pump 36 generates a certain pressure head to circulate the soda throughout the system. That pressure head drops from inherent system and line losses from the outlet of the pump 36 to its inlet where the soda returns. Obviously, the pump 36 generates a pressure head greater than that introduced to the tank 40 by the regulated pressurized carbon dioxide source 24. In a preferred embodiment, the pump 36 generates a 115 psi pumping head. In any event, the fact that there is a very gradual reduction in pressure throughout the recirculating soda system in the direction of soda flow allows the dispensing lines 50 to also enter into the recirculation path. Where a shunt 62 interconnects the input 42 with the dispensing line 50, it will be appreciated that the pressure in the line 42 at the point of interconnection with the shunt 62 is greater than that within the tank 40 by a minimal amount. This pressure differential allows some of the soda in the line 42 to be diverted through the shunt 62 and into the dispensing line 50 to backwash the soda with a trickling effect into the tank 40. In like fashion, the pressure within the auxiliary tank 40 is greater than that at the output 44 by a minimal amount and, accordingly, a slight trickle of soda occurs through the dispensing line 50 and shunt 64 to the output 44. Accordingly, even the dispensing lines 50 are recirculated.

FIG. 2 is an illustrative schematic of the insulated auxiliary tank 40. As shown therein, the input 42 terminates near the bottom of the tank 40 at one end thereof, while the output 44 terminates near the bottom of the auxiliary tank 40 at the other end. Accordingly, the soda that passes through the input 42 is added to the reservoir, while an equal volume of different soda finds its way to the output 44. All of the soda is subjected to an environment of pressurized carbon dioxide to recarbonate the soda in the event that any carbon dioxide has escaped as a result of turbulence experienced in the flow path. This same pressure head controls the dispensing of soda through the dispensing lines 50. Since the dispensing is under control of this pressure source, the reliability of soda flow control compensators at each of the dispensing heads is less critical than in prior art embodiments.

As mentioned above, when the float switch 58 senses that the reservoir of soda has reached a predetermined low level, the float switch 58 activates the valve 56 opening such valve to allow carbon dioxide to vent through the passage 54 and check valve 60 to the atmosphere. This release of head pressure, though only on the order of less than 10% of the available head pressure, allows for introduction of additional soda from the carbonator 14 through the pump 36 and input 42 to replenish the reservoir. The carbon dioxide gas slowly escapes through the high cracking pressure check valve 60 while the reservoir is replenished with soda. With the cracking pressure of the check valve 60 being less than 5 psi below the characteristic head pressure of the auxiliary tank 40, there is an assurance that sufficient head pressure remains within the auxiliary tank 40 to achieve dispensing of syrup even while the reservoir is being refilled. Accordingly, the valve 60 assures that carbon dioxide is conserved and that dispensing may be achieved even while the reservoir is refilling with soda.

It will also be understood that the auxiliary tank 40 is pressure sensitive in that the check valve 48 assures that a head pressure substantially equal to that of the regulated source 24 is always present for dispensing of soda.

It should be apparent to those skilled in the art that the instant invention can be used as a retrofit to existing soda systems. The auxiliary tank of the invention provides means for totally recirculating the soda, recarbonating the soda, maintaining an increased reservoir of cold soda immediately available for dispensing, and assuring that even the soda in the dispensing line at the dispensing head is recirculated and refreshed. Dispensing is achieved under pressure control which is effectively and efficiently regulated by means of a check valve having a desired characteristic cracking pressure, while refilling of the auxiliary tank does not interfere with dispensing operations.

It should also be understood by those skilled in the art that an auxiliary tank 40 may be interposed between dispensing stations but with no dispensing lines 50 extending therefrom for the purpose of increasing the cooling, recarbonating, and dispensing capabilities of the system as a whole by maintaining a set pressure therein.

Thus it can be seen that the objects of the invention have been satisified by the structure presented hereinabove. While in accordance with the patent statutes only the best mode and preferred embodiment of the invention has been presented and described in detail, it is to be understood that the invention is not limited thereto or thereby. Accordingly, for an appreciation of the scope and breadth of the invention reference should be had to the appended claims.

What is claimed is:

1. A soda system for a soft drink dispenser, comprising:

a carbonator interconnected between a source of water and a source of carbon dioxide for generating soda;

a pump connected to said carbonator and circulating soda to at least one dispensing station and returning said soda to said carbonator; and an auxiliary tank receiving said soda from said pump and in communication with said source of carbon dioxide, said auxiliary tank maintaining a reservoir of soda therein under a pressure head from said source of carbon dioxide said auxiliary tank further having an inlet passage receiving soda from said pump and an outlet passage returning soda to said pump, a first means for sensing the level of said reservoir of soda, a vent from said pressure head to atmosphere, said vent selectively opened and closed by a first valve under control of said first means, and including a first check valve limiting a rate of escape of said head of carbon dioxide to atmosphere upon opening of said first valve.

2. The soda system according to claim 1 wherein said first check valve has a characteristic cracking pressure which is less than a first percentage of a pressure supplied by said source of carbon dioxide.

3. The soda system according to claim 2 which further includes a second check valve interposed between said auxiliary tank and said source of carbon dioxide, said second check valve having a characteristic cracking pressure which is a second percentage of said pressure supplied by said source of carbon dioxide, said first percentage being greater than said second percentage.

4. The soda system according to claim 1 which further includes a dispensing tube from said auxiliary tank to a pour head, a dispensing valve maintained in said dispensing tube between said auxiliary tank and said pour head.

5. The soda system according to claim 4 which further includes a shunt tube interconnected between said inlet passage and said dispensing tube.

6. The soda system according to claim 4 which further includes a shunt tube interconnected between said outlet passage and said dispensing tube.

7. A system for generating and maintaining soda for dispensing in a soft drink system, comprising:

a carbonator for generating soda;

a pressurized source of carbon dioxide in communication with said carbonator;

a pump connected to said carbonator and at lease one dispensing station for circulating soda to and from said dispensing station;

an auxiliary tank receiving said soda from said pump and in communication with said source of carbon dioxide, said auxiliary tank maintaining a reservoir of soda under a pressure head of carbon dioxide provided by said source of carbon dioxide and having an inlet passage receiving soda from said pump and an outlet passage returning soda to said pump; and a float switch maintained within said auxiliary tank and operatively connected to a first valve maintained within a vent within said auxiliary tank, said float switch selectively venting said pressure head to atmosphere through said first valve.

8. The system according to claim 9 wherein said vent further includes a check valve having a characteristic cracking pressure in excess of ninety percent of a pressure level of said pressurized source of carbon dioxide.

9. The system according to claim 8 which further includes a dispensing tube from said auxiliary tank to a pour head, a dispensing valve being maintained in said dispensing tube.

10. The system according to claim 9 which further includes a passage interconnected directly between said inlet passage and said dispensing tube.

11. The system according to claim 9 which further includes a passage interconnected directly between said outlet passage and said dispensing tube.

* * * * *